US008791348B2

(12) United States Patent
Yu

(10) Patent No.: US 8,791,348 B2
(45) Date of Patent: Jul. 29, 2014

(54) ADJUSTMENT ASSEMBLY FOR SNARE WIRES

(71) Applicant: Chosen Fat Co., Ltd., Taichung (TW)

(72) Inventor: Wei-Mei Yu, Taichung (TW)

(73) Assignee: Chosen Fat Co., Ltd., Taichung (TW)

( * ) Notice: Subject to any disclaimer, the term of this patent is extended or adjusted under 35 U.S.C. 154(b) by 18 days.

(21) Appl. No.: 13/726,209

(22) Filed: Dec. 23, 2012

(65) Prior Publication Data

US 2014/0174278 A1 Jun. 26, 2014

(51) Int. Cl.
*G10D 13/02* (2006.01)

(52) U.S. Cl.
CPC ..... *G10D 13/025* (2013.01); *G10D 13/023* (2013.01); *G10D 13/02* (2013.01)
USPC ..... 84/415; 84/411 R; 84/417

(58) Field of Classification Search
CPC ..... G10D 13/025; G10D 13/02
USPC ..... 84/415, 411 R, 417
See application file for complete search history.

(56) References Cited

U.S. PATENT DOCUMENTS 3,635,119 A * 1/1972 Thompson ..... 84/411 R
5,559,296 A * 9/1996 Yamashita ..... 84/415
5,844,157 A * 12/1998 Kasha ..... 84/415
6,093,877 A * 7/2000 Nickel ..... 84/415
6,958,440 B2 * 10/2005 Yu-Hwa ..... 84/415
7,220,905 B2 * 5/2007 Takegawa ..... 84/415
7,262,355 B2 * 8/2007 Hagiwara et al. ..... 84/415
7,745,712 B2 * 6/2010 Dunnett ..... 84/415
8,143,507 B2 * 3/2012 Good et al. ..... 84/413
8,350,139 B2 * 1/2013 Lutz et al. ..... 84/415
2004/0168563 A1 * 9/2004 Dorfman et al. ..... 84/415
2005/0188818 A1 * 9/2005 Okamoto ..... 84/415
2005/0223875 A1 * 10/2005 Hagiwara et al. ..... 84/415
2005/0241457 A1 * 11/2005 Shimada ..... 84/415
2006/0213353 A1 * 9/2006 Takegawa ..... 84/415
2006/0266198 A1 * 11/2006 Jeffries et al. ..... 84/417
2009/0133564 A1 * 5/2009 Miyajima ..... 84/415
2010/0242707 A1 * 9/2010 Miyajima ..... 84/415
2010/0313733 A1 * 12/2010 Holl et al. ..... 84/415
2011/0023686 A1 * 2/2011 Nakata et al. ..... 84/415
2011/0120286 A1 * 5/2011 Good et al. ..... 84/415

* cited by examiner

*Primary Examiner* — David Warren
*Assistant Examiner* — Christina Russell

(57) ABSTRACT

An adjustment assembly for snare wires includes an adjustment unit and a pressing unit respectively located on two opposite positions of the shell of a snare drum. The adjustment unit has a body with a slide slot. A shifting member is slidably connected to the body and driven by a driving member connected to the body. The shifting member has a wire carrier which is adjusted by rotating an adjusting bolt. The pressing unit includes another wire carrier which is controlled by another adjusting bolt. By adjustment of the two adjustment bolts, the tension of the snare wires can be adjusted.

7 Claims, 10 Drawing Sheets

ADJUSTMENT ASSEMBLY FOR SNARE WIRES

BACKGROUND OF THE INVENTION (1) Field of the Invention

The present invention relates to an adjustment assembly for snare wires, and more particularly, to an adjustment assembly for quickly and conveniently adjust the tension of the snare wires of a snare drum.

(2) Description of the Prior Art

The conventional snare wires for a snare drum are connected to the bottom head of a snare drum and the tension of the snare wires directly affects the sound when playing the snare drum. The sound becomes higher along with the increment of the tension of the snare wires. The conventional adjustment unit for adjusting the tension of the snare wires comprises a pressing unit connected to the peripheral position of the shell of the drum and the pressing unit pulls the snare wire to have a tension. The conventional pressing unit has two protrusions on the hollow body, and a wire carrier and a block are respectively connected to the two protrusions. The wire carrier has an eccentric member which is located on the shell and pivoted by a lever so as to adjust the tension of the snare wire. The slide member secures the two ends of the snare wire by a fixing member and a pressing board. The slide member has an adjustment bolt on its rear end to micro adjust the snare wire.

However, the users have to shift the lever from right to left for a long travel distance to pivot the eccentric member such that the slide member moves up and down. This is not convenient for the users. Besides, when adjusting the tension of the snare wire, the block is positioned to the adjustment bolt or moved along the adjustment bolt pulls the snare wire at an angle such that the snare wire cannot normally be positioned in a horizontal direction, and the snare wire is broken when it is maintained at the status.

Taiwan Publication No. 341357 discloses an adjustment unit for snare wires, and which can improve the shortcomings mentioned above, however, the complicated structure makes the manufacturing be difficult and therefore, a high manufacturing cost is involved. Besides, after a long period of operation, the adjustment unit tends to loosened and shakes.

The present invention intends to provide an adjustment assembly for snare wires and improves the shortcomings of the conventional adjustment units.

SUMMARY OF THE INVENTION

The present invention relates to an adjustment assembly for snare wires, and comprises an adjustment unit and a pressing unit respectively located on two opposite positions of the shell of a snare drum. The adjustment unit has a first body, a shifting member and a first wire carrier, wherein the first body is secured to the shell of the snare drum. The first body has a first slide slot with an open top, and a side pillar is connected to one side of the first body and extends from the top to the bottom of the first body. A recess is defined in the other side of the first body and opens outward. A cover is connected to the first body. The shifting member has a passage defined centrally therethrough and the wire carrier is slidably located in the passage. A driving member is connected to the side pillar by a securing member and the driving member has a lever extending through the recess. An elongate slot is defined in the driving member and a pin extends through the elongate slot and contacts the top of the shifting member. The first wire carrier has an adjustment bolt which extends through the rear end of the shifting member, and a first knob is connected to one end of the adjustment bolt that protrudes beyond the shifting member. The first wire carrier is connected to pull cables of a snare wire.

The pressing unit has a second body and a second wire carrier, wherein the second body is connected to the shell of the snare drum and has a second slide slot. The second wire carrier is slidably located in the second slide slot and has a second adjustment bolt which extends through the rear end of the second body. A second knob is connected to one end of the second adjustment bolt that protrudes beyond the second body. The second wire carrier is connected to pull cables of the snare wire.

The primary object of the present invention is to provide an adjustment assembly for snare wires, and the adjustment unit is simplified and easily manufactured, the operation of the adjustment unit is smooth and convenient.

Another object of the present invention is to provide an adjustment assembly for snare wires, wherein the snare wires can be quickly tightened and loosened.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
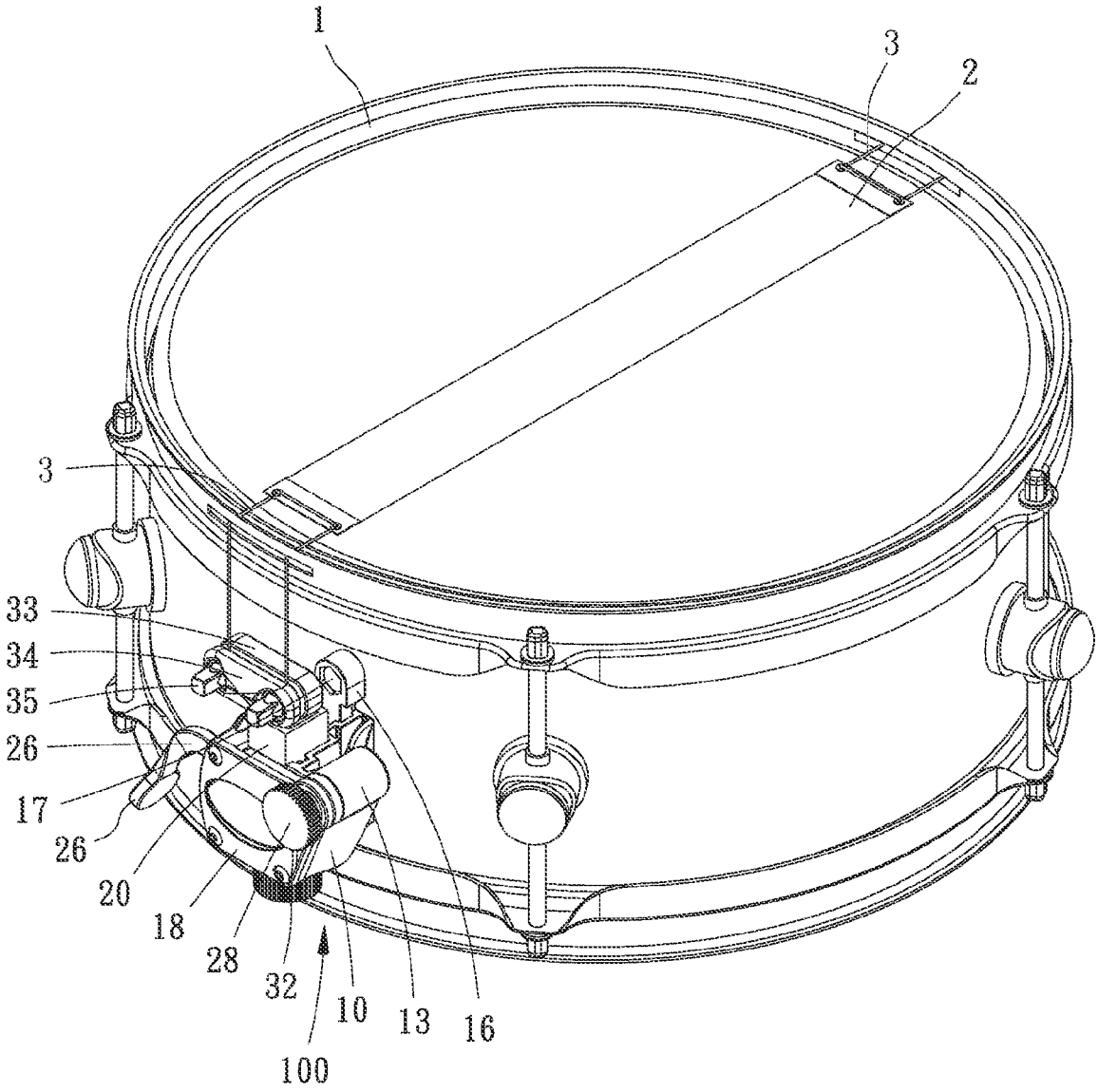
FIG. 1 is a perspective view to show that the snare wires adjustment assembly of the present invention is connected to the shell of the snare drum.
Figure 2:
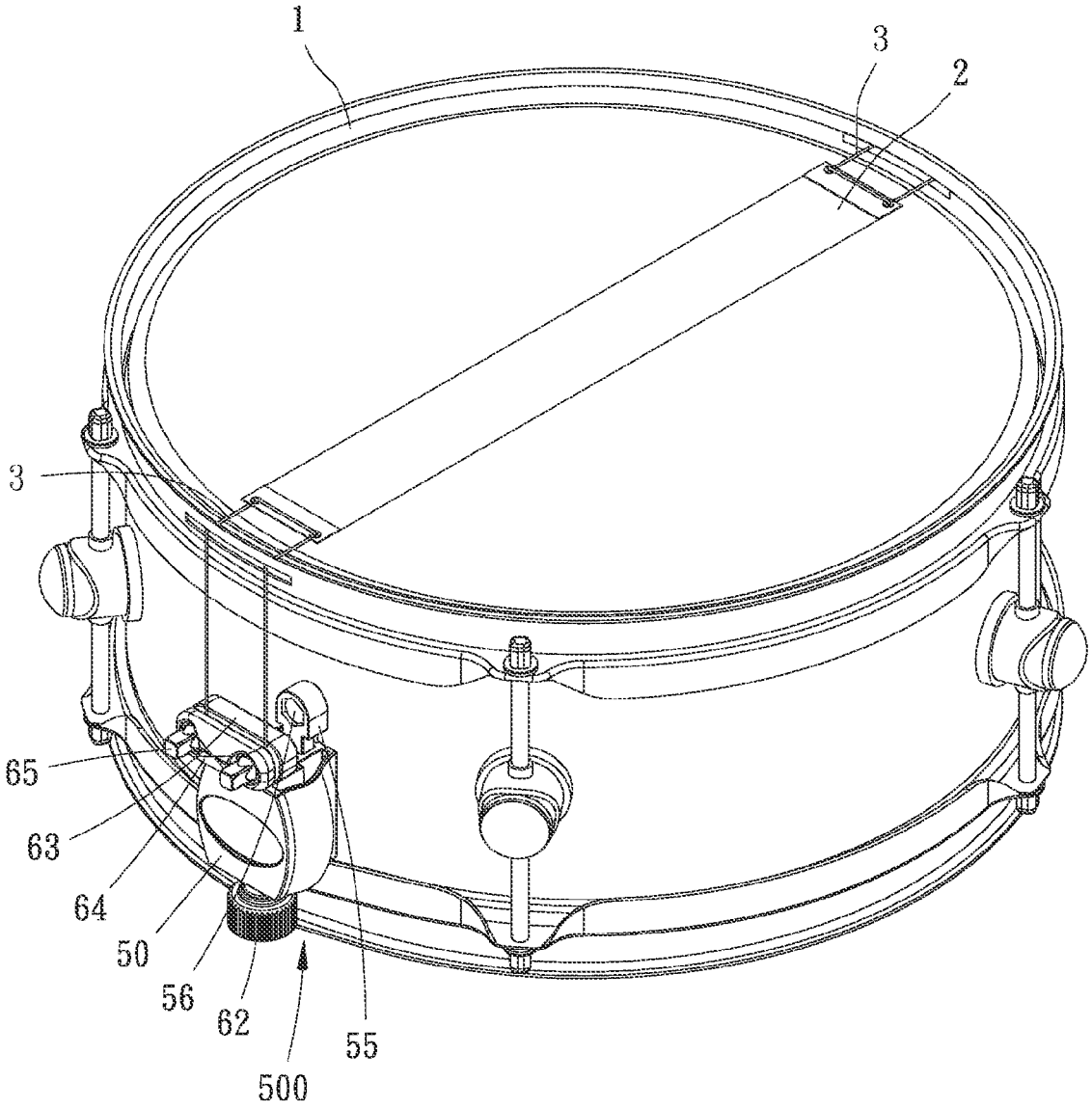
FIG. 2 is another perspective view to show that the snare wires adjustment assembly of the present invention is connected to the shell of the snare drum.
Figure 3:
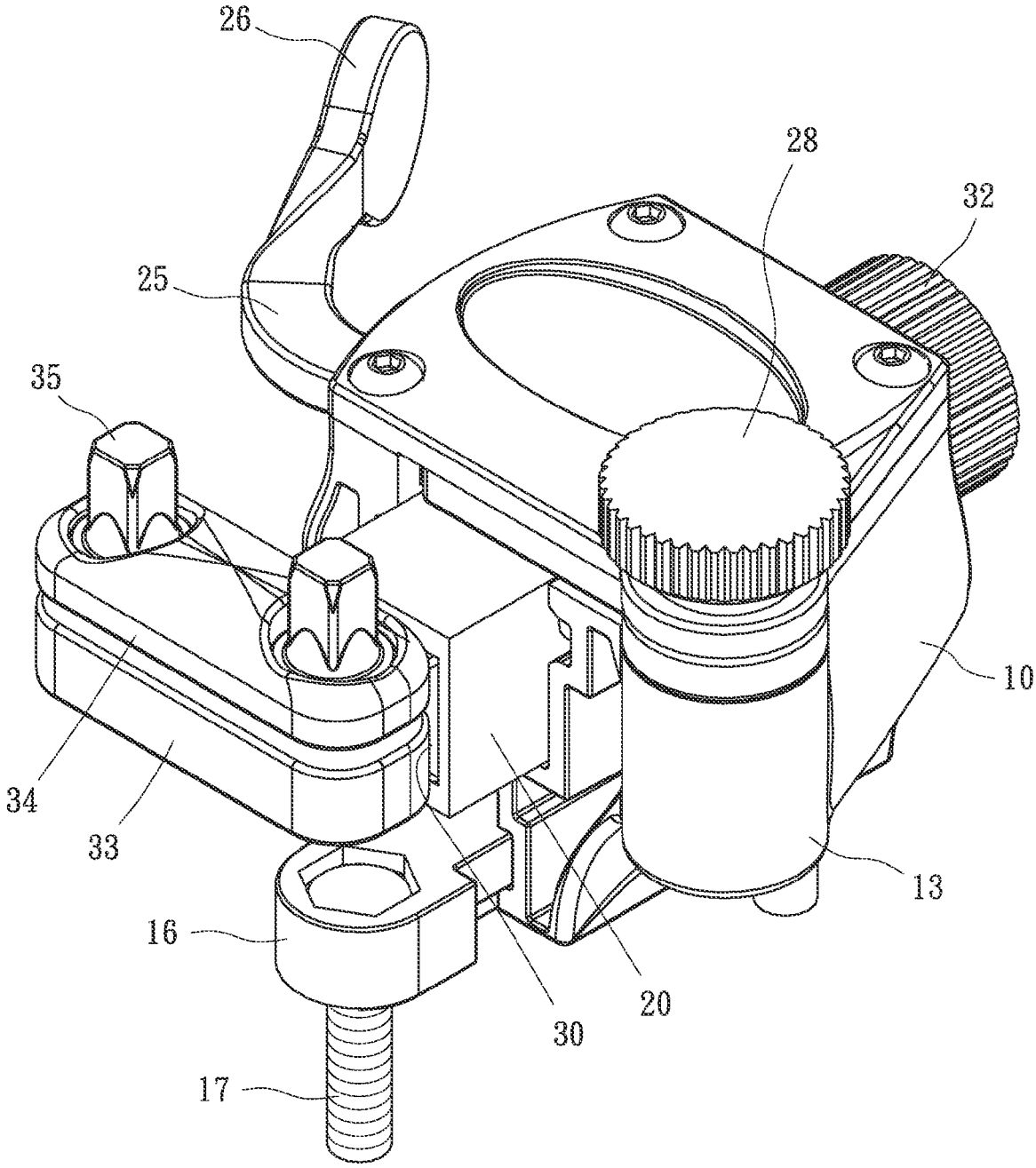
FIG. 3 is a perspective view to show the adjustment unit of the present invention.
Figure 4:
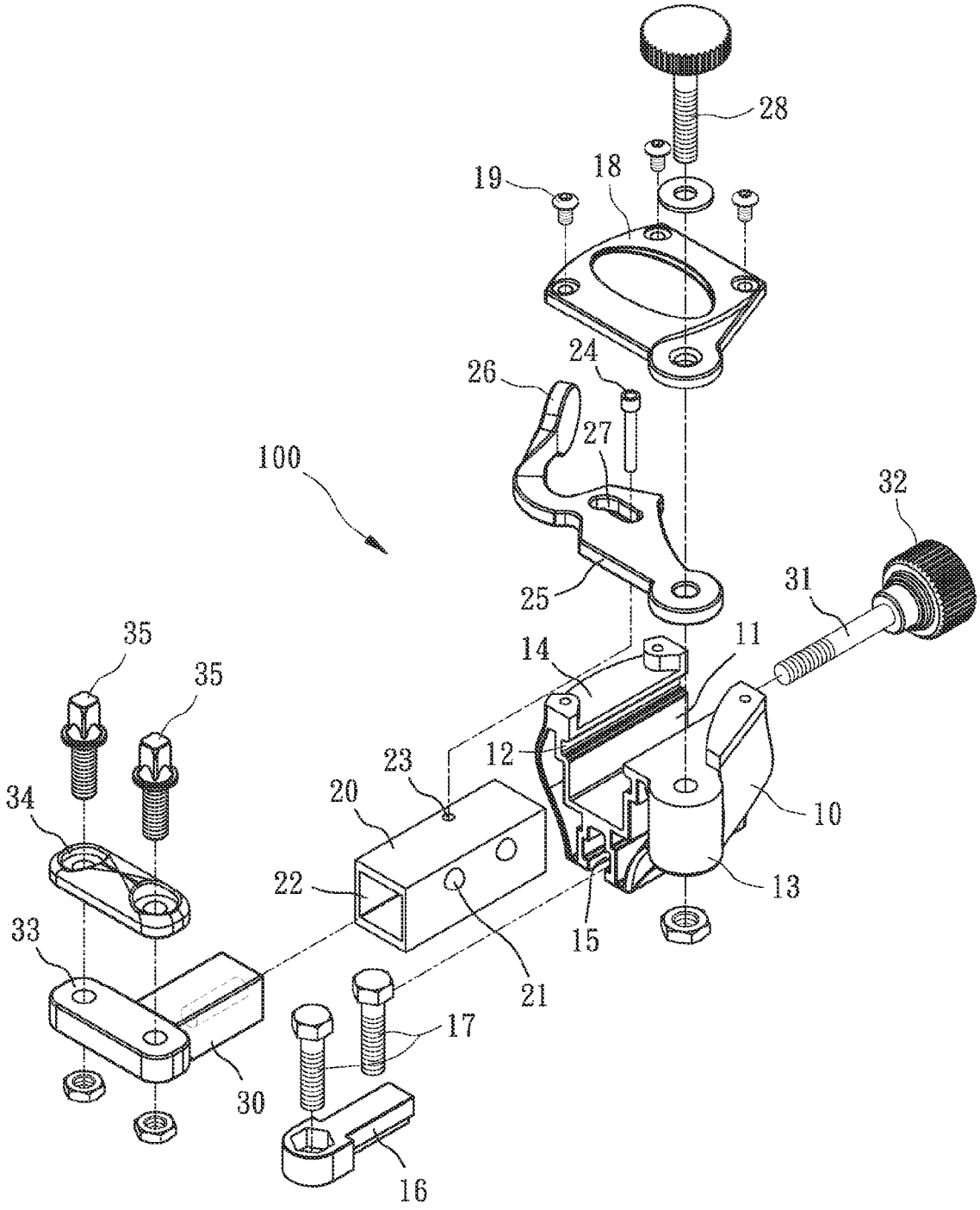
FIG. 4 is an exploded view to show the adjustment unit of the present invention.

Referring to FIGS. 1 and 2, the snare wires adjustment assembly of the present invention comprises an adjustment unit 100 and a pressing unit 500 respectively located on two opposite positions of the shell of a snare drum 1. The adjustment unit 100 and the pressing unit 500 respectively secure the pull cables 3 one two ends of the snare wires 2.

Figure 5:
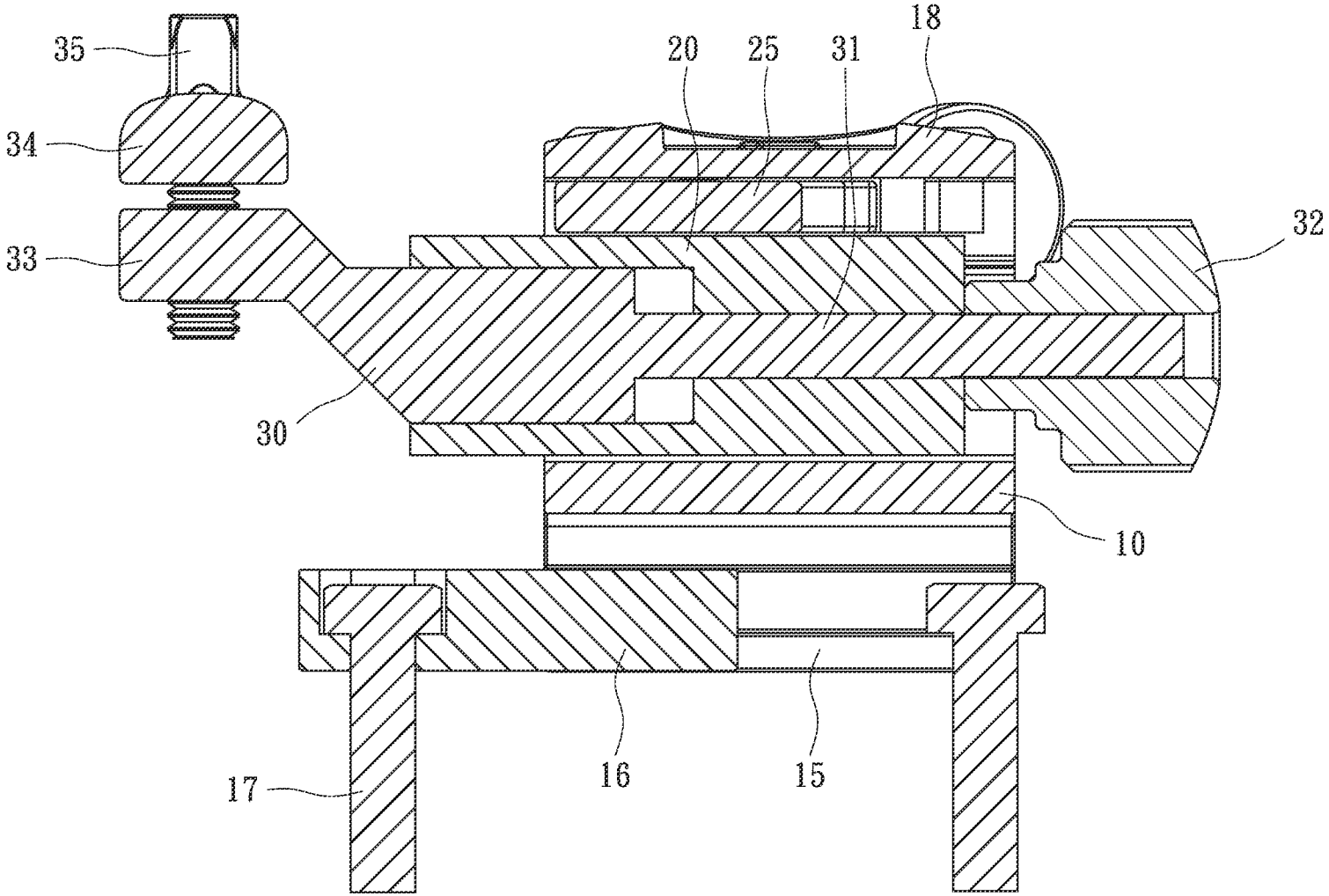
FIG. 5 is a side cross sectional view to show the adjustment unit of the present invention.
Figure 6:
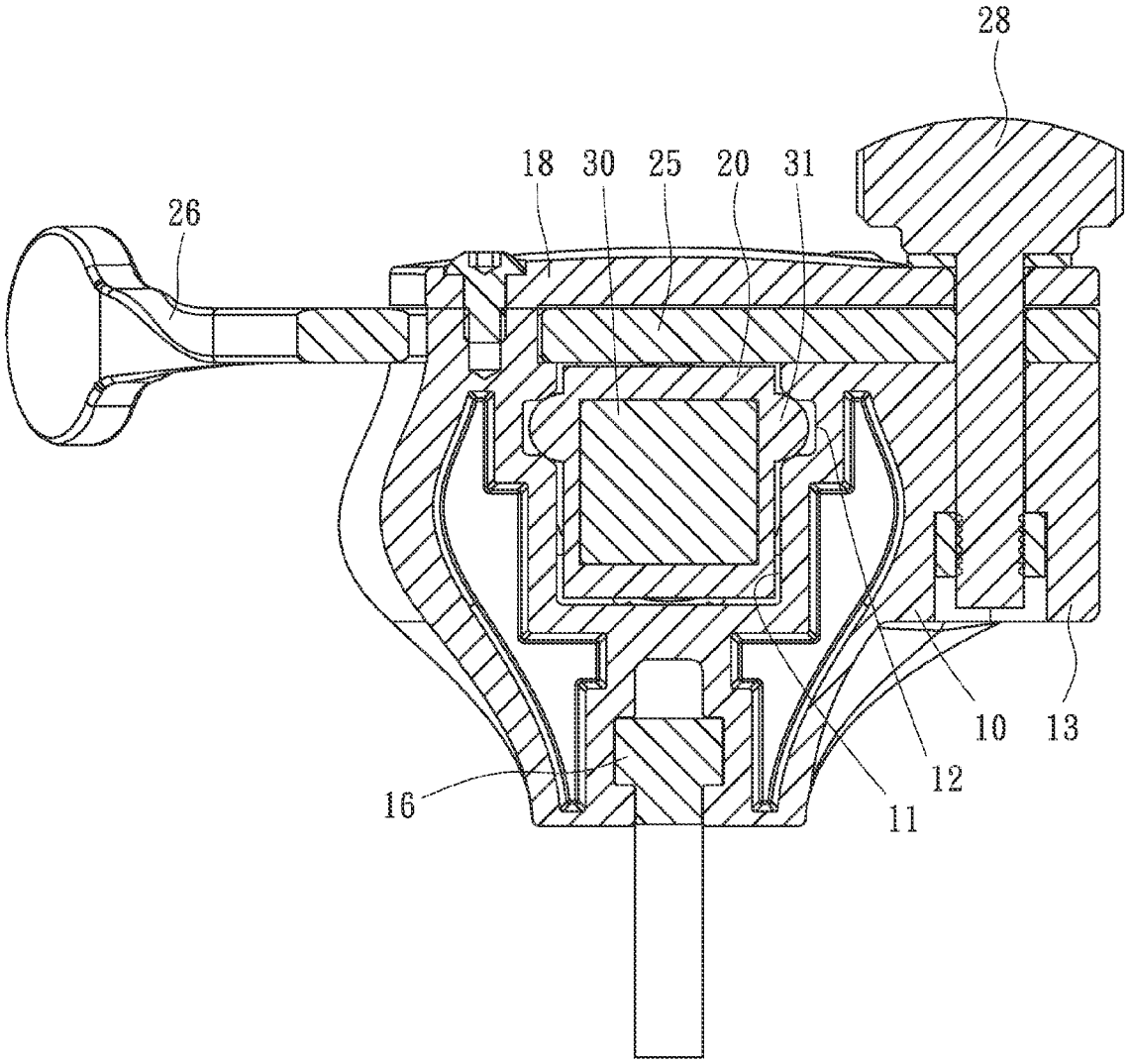
FIG. 6 is a front cross sectional view to show the adjustment unit of the present invention.

As shown in FIGS. 4 to 7, the adjustment unit 100 comprises a first body 10, a shifting member 20 and a first wire carrier 30, wherein the first body 10 is made by Zinc alloy and secured to the shell of the snare drum 1. The first body 10 has a first slide slot 11 with an open top, so that the shifting member 20 is slidably engaged with the first slide slot 11. The first slide slot 11 has two guide grooves 12 which are respectively defined in two inside walls of the first slide slot 11. A side pillar 13 is connected to one side of the first body 10 and extends from the top to the bottom of the first body 10. A recess 14 is defined in the other side of the first body 10 and opens outward. The first body 10 has a T-shaped first engaging slot 15 defined in the bottom thereof, and a first block 16 is optionally and slidably located in the first engaging slot 15. The first engaging slot 15 and the first block 16 are respectively secured to the body 10 by two respective locking members 17. The adjustment unit 100 is able to be connected to drums 1 of different sizes by moving the first block 16 as shown in FIGS. 5 and 6. A cover 18 is connected to the first body 10 by bolts 19.

Figure 7:
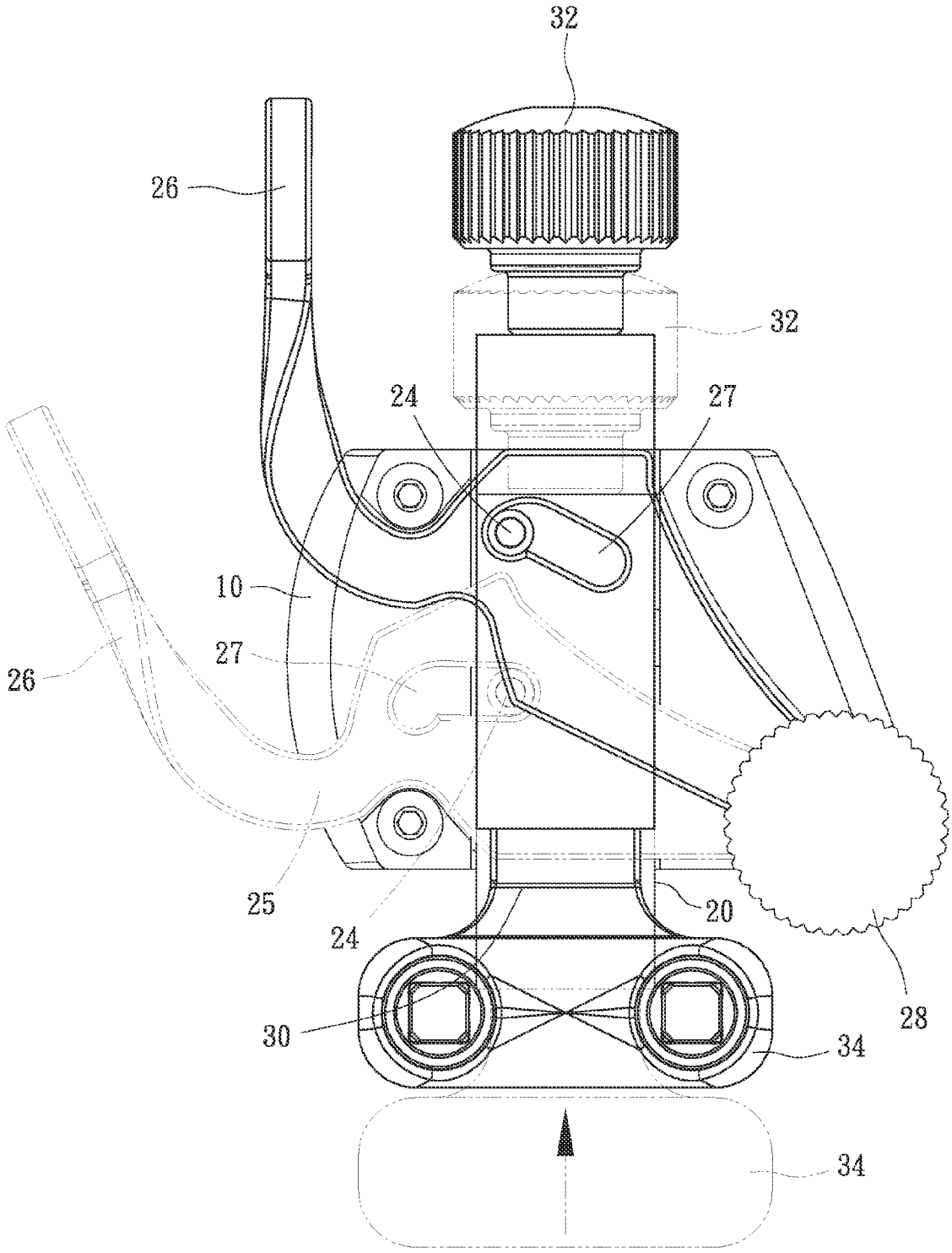
FIG. 7 is a top view to show the operation of the adjustment unit of the present invention.

The shifting member 20 is made by plastic so that the shifting member 20 is movable in the first body 10 silently. The shifting member 20 has two bosses 21 on two sides thereof, as shown In FIG. 6, the bosses 21 are slidably engaged with the two guide grooves 12 so that the shifting member 20 is movable in the first body 10 quickly and smoothly. The shifting member 20 has a passage 22 defined centrally therethrough and a hole 23 is defined in the top of the shifting member 20, so that the pin 24 is inserted into the hole 23. The wire carrier 30 is slidably located in the passage 22. A driving member 25 is connected to the side pillar 13 by a securing member 28 and the driving member 25 has a lever 26 extending through the recess 14. An elongate slot 27 is defined in the driving member 25 and the pin 24 extends through the elongate slot 27, so that when the user shifts the driving member 25, the shifting member 20 is co-moved by the pin 24 as shown in FIG. 7.

The first wire carrier 30 has an adjustment bolt 31 which extends through the rear end of the shifting member 20. A first knob 32 is connected to one end of the adjustment bolt 31 that protrudes beyond the shifting member 20, so that the position of the first wire carrier 30 is adjusted relative to the shifting member 20 as shown In FIG. 5. A first bar 33 is connected to the front end of the first wire carrier 30 and a first pressing board 34 is connected to the first bar 33 by two locking members 35. The pull cables 3 are clamped by the first bar 33 and the first pressing board 34 as shown in FIG. 1.

Figure 8:
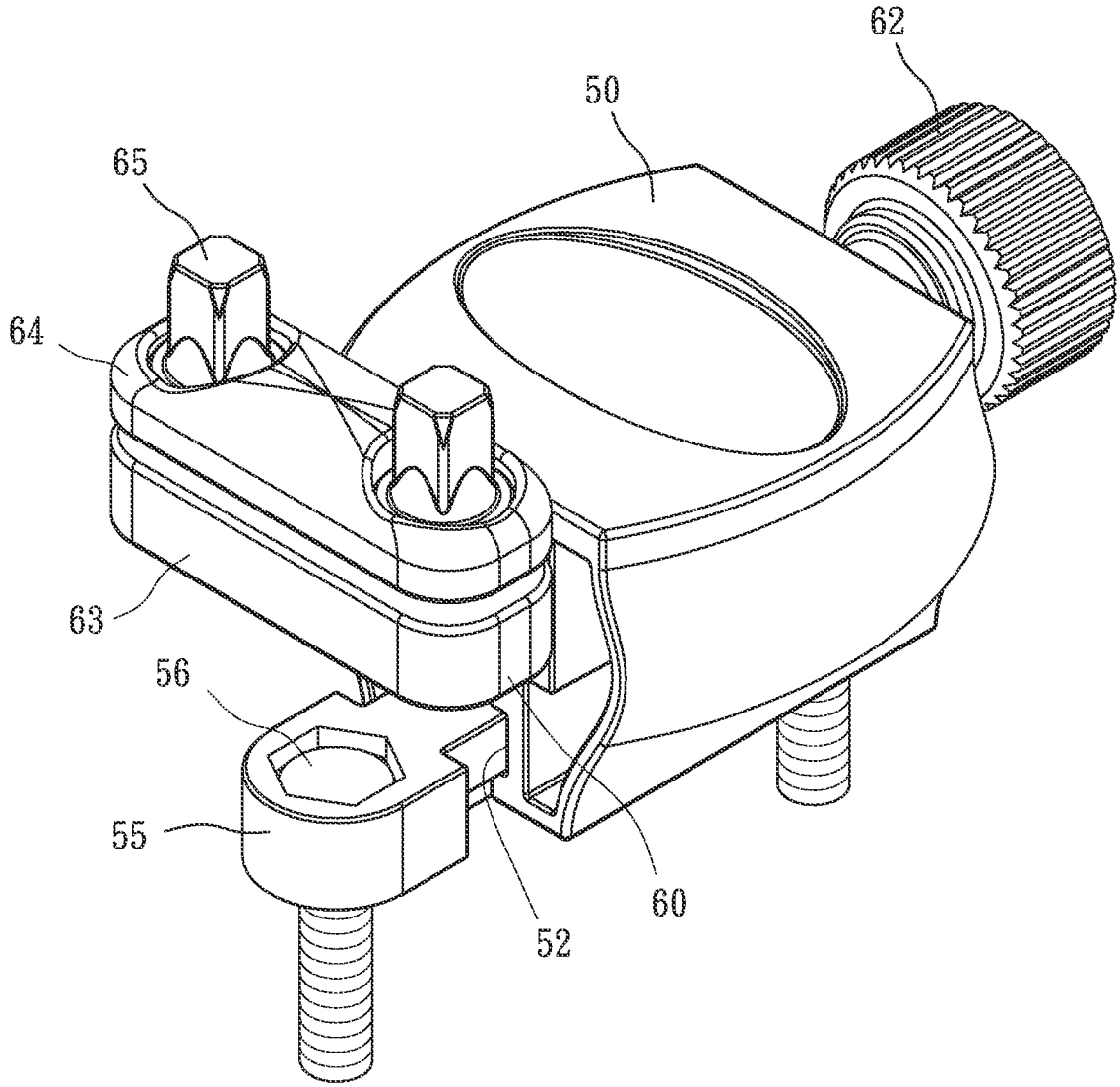
FIG. 8 is a perspective view to show the pressing unit of the present invention.
Figure 9:
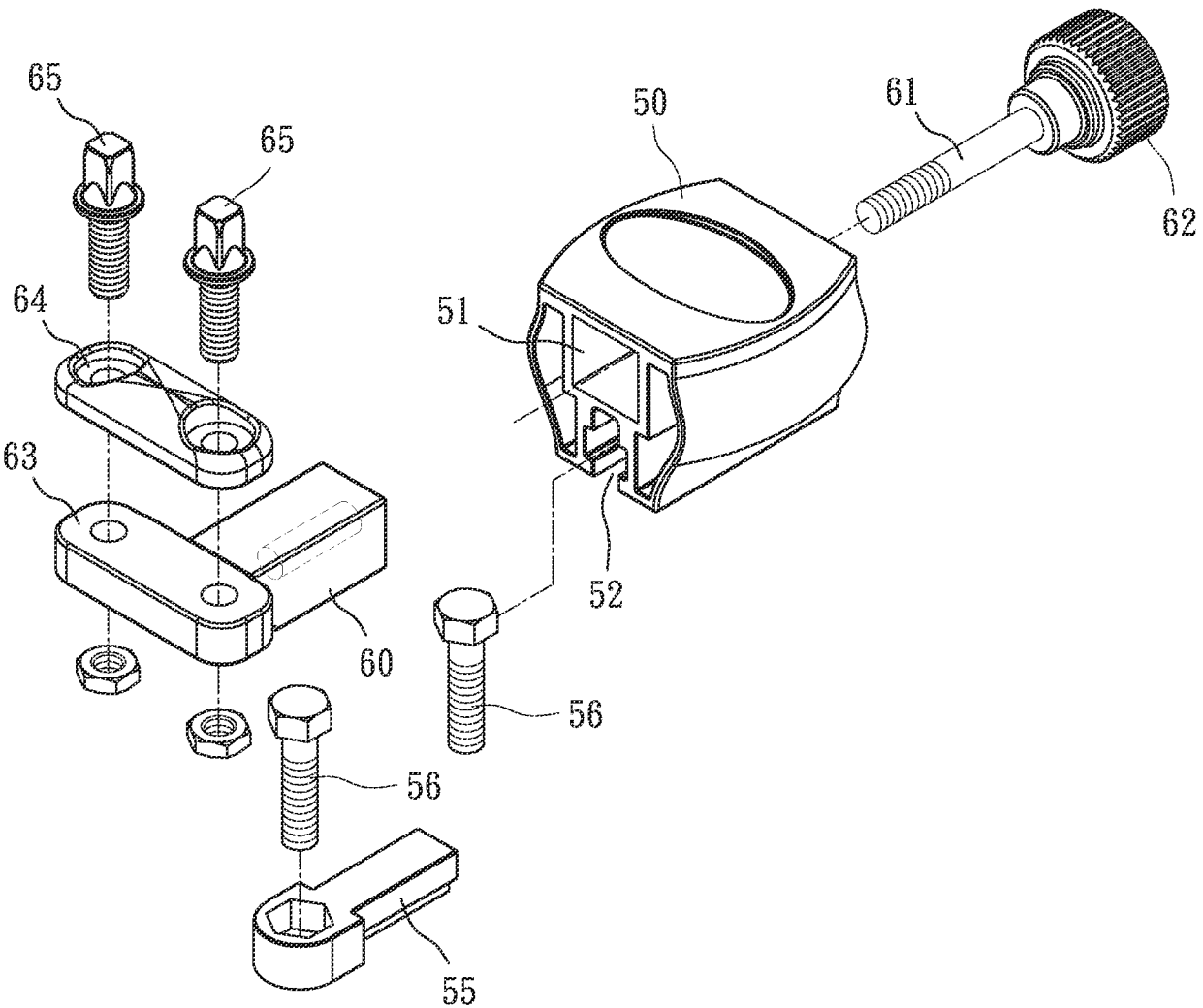
FIG. 9 is an exploded view to show the pressing unit of the present invention.
Figure 10:
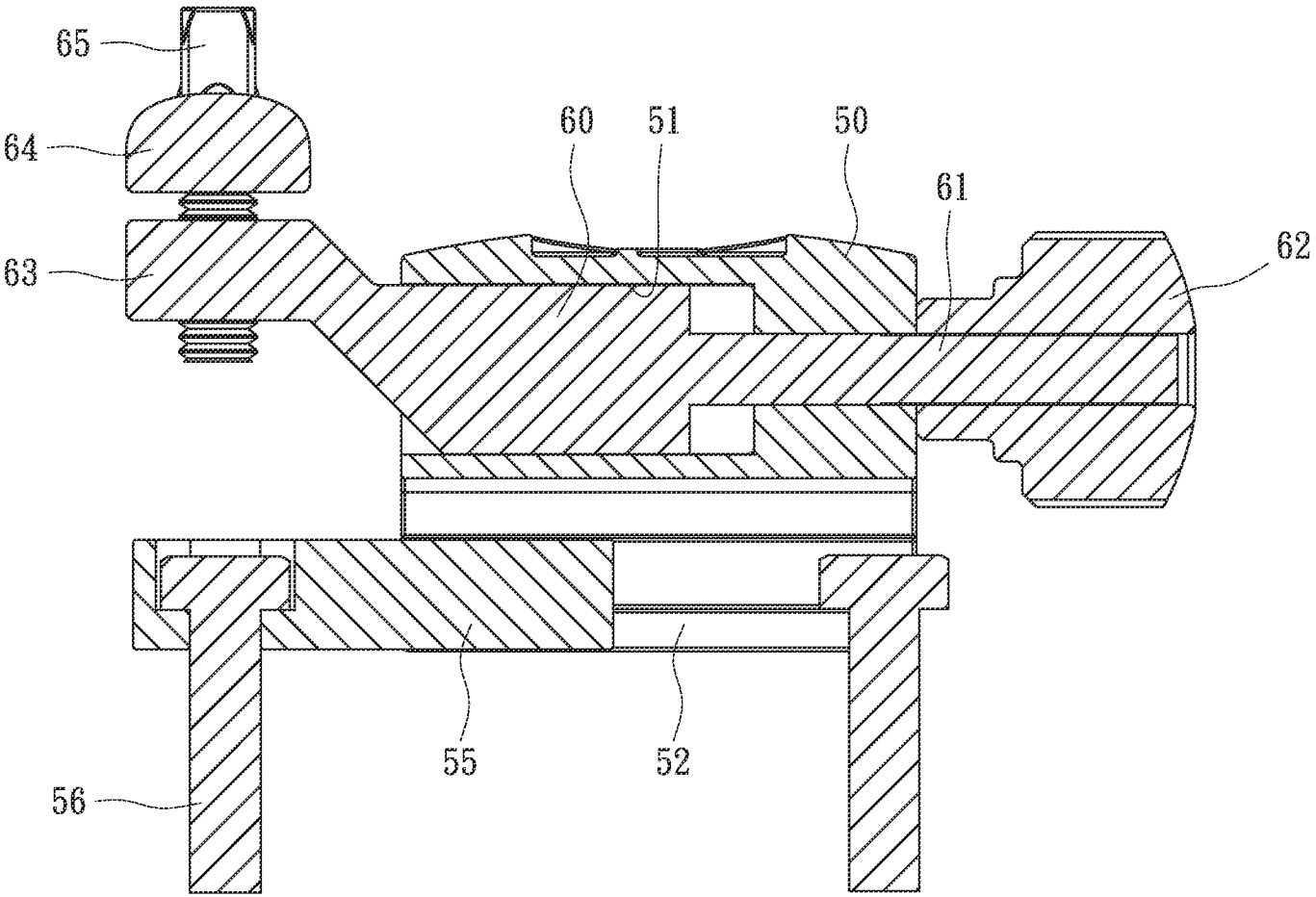
FIG. 10 is a cross sectional view of the pressing unit of the present invention.

As shown in FIGS. 8 to 10, the pressing unit 500 has a second body 50 and a second wire carrier 60, wherein the second body 50 connected to the shell of the snare drum 1 and has a second slide slot 51 in which the second wire carrier 60 is slidably located. The second body 50 has a T-shaped second engaging slot 52 defined in the bottom thereof, and a second block 55 is optionally and slidably located in the second engaging slot 52. The second engaging slot 52 and the second block 55 are respectively secured to the second body 50 by two respective locking members 56. The pressing unit 500 is connected to drums 1 of different sizes by moving the second block 55 as shown in FIG. 10.

The second wire carrier 60 has a second adjustment bolt 61 which extends through the rear end of the second body 50. A second knob 62 is connected to one end of the second adjustment bolt 61 that protrudes beyond the second body 50 so that the position of the second wire carrier 60 is adjusted relative to the second body 50 as shown in FIG. 10. A second bar 63 is connected to the front end of the second wire carrier 60 and a second pressing board 64 is connected to the second bar 63 by two locking members 65. The pull cables 3 on the other end of the snare wire are clamped by the second bar 63 and the second pressing board 64 as shown in FIG. 2.

As shown in FIGS. 1, 2, 3 and 8, when in use, the adjustment unit 100 and the pressing unit 500 are respectively located on two opposite positions of the shell of a snare drum 1 by the locking members 17, 56 of the first and second bodies 10, 50. By adjusting the first and second blocks 16, 55, the present invention can be connected to the drums 1 of different sizes. The pull cables 3 on the two ends of the snare wires 2 are clamped by the first, second bars 33, 63, and the first and second pressing boards 34, 64. The locking members 35, 65 secure the pull cables 3 to fix the snare wires 2 to the adjustment unit 100 and the pressing unit 500.

When adjusting the tension of the snare wires 2, the first knob 32 of the adjustment unit 100 or the second knob 62 of the pressing unit 500 is rotated in clockwise or counter clockwise to change the positions of the first wire carrier 30 or the second wire carrier 60 so that the tension of the snare wires 2 is adjusted. Because the adjustment unit 100 and the pressing unit 500 can be respectively adjusted, so that the snare wires 2 are maintained at the center of the drum head.

When the tension of the snare wires 2 is needed to be adjusted quickly, the user shifts the driving member 25 of the adjustment unit 100 directly by operating the lever 26, the driving member 25 drives the shifting member 20 to move via the pin 24 as shown in FIG. 7 so as to quickly adjust the tension of the snare wires 2.

The first body 10 is made by Zinc alloy and the shifting member 20 is made by plastic so that when adjusting the tension of the snare wires 2, the shifting member 20 moves in the guide grooves 12 of the first body 10 silently.

While we have shown and described the embodiment in accordance with the present invention, it should be clear to those skilled in the art that further embodiments may be made without departing from the scope of the present invention.

What is claimed is:

1. An adjustment assembly for snare wires, comprising:

an adjustment unit and a pressing unit respectively located on two opposite positions of a shell of a snare drum, the adjustment unit having a first body, a shifting member and a first wire carrier, the first body being secured to the shell of the snare drum, the first body having a first slide slot with an open top, a side pillar connected to one side of the first body and extending from a top to a bottom of the first body, a recess defined in the other side of the first body and opening outward, a cover connected to the first body, the shifting member having a passage defined centrally therethrough and the wire carrier being slidably located in the passage, a driving member connected to the side pillar by a securing member and the driving member having a lever extending through the recess, an elongate slot defined in the driving member and a pin extending through the elongate slot and contacting a top of the shifting member, the first wire carrier having an adjustment bolt which extends through a rear end of the shifting member, a first knob connected to an end of the adjustment bolt that protrudes beyond the shifting member, the first wire carrier connected to pull cables of snare wires, and the pressing unit having a second body and a second wire carrier, the second body connected to the shell of the snare drum and having a second slide slot, the second wire carrier slidably located in the second slide slot, the second wire carrier having a second adjustment bolt which extends through a rear end of the second body, a second knob connected to an end of the second adjustment bolt that protrudes beyond the second body, the second wire carrier connected to pull cables of the snare wires.

2. The adjustment assembly as claimed in claim 1, wherein the first body of the adjustment unit has a T-shaped first engaging slot defined in a bottom thereof, a first block is optionally and slidably located in the first engaging slot, the first engaging slot and the first block are respectively secured to the body by two respective locking members, the adjustment unit is connected to drums of different sizes by moving the first block.

3. The adjustment unit as claimed in claim 1, wherein the first slide slot has two guide grooves which are respectively defined in two inside walls of the first slide slot, the shifting member has two bosses on two sides thereof, the bosses are slidably engaged with the two guide grooves so that the shifting member is movable in the first body stably.

4. The adjustment assembly as claimed in claim 1, wherein the first body is made by Zinc alloy and the shifting member is made by plastic so that the shifting member is movable in the first body silently.

5. The adjustment assembly as claimed in claim 1, wherein a first bar is connected to a front end of the first wire carrier and a first pressing board is connected to the first bar by two locking members, the pull cables are clamped by the first bar and the first pressing board.

6. The adjustment assembly as claimed in claim 1, wherein the second body of the pressing unit has a T-shaped second engaging slot defined in a bottom thereof, a second block is optionally and slidably located in the second engaging slot, the second engaging slot and the second block are respectively secured to the second body by two respective locking members, the pressing unit is connected to drums of different sizes by moving the second block.

7. The adjustment assembly as claimed in claim 1, wherein a second bar is connected to a front end of the second wire carrier and a second pressing board is connected to the second bar by two locking members, the pull cables are clamped by the second bar and the second pressing board.

* * * * *